US005905648A

United States Patent [19]

Badami

[11] Patent Number: 5,905,648

[45] Date of Patent: May 18, 1999

[54] APPLIANCE PERFORMANCE CONTROL APPARATUS AND METHOD

[75] Inventor: Vivek Venugopal Badami, Schenectady, N.Y.

[73] Assignee: General Electric Company, Schenectady, N.Y.

[21] Appl. No.: 08/968,732

[22] Filed: Nov. 12, 1997

Related U.S. Application Data

[ 60] Provisional application No. 60/030,663, Nov. 12, 1996.

[51] Int. Cl.[6] ..... D06F 33/02

[52] U.S. Cl. ..... 364/148.1; 702/199

[58] Field of Search ..... 702/189, 190, 702/191, 199; 364/138, 140, 148; 395/1, 3

[56] References Cited

U.S. PATENT DOCUMENTS

| | | | |
|---|---|---|---|
| 4,481,786 | 11/1984 | Bashark | 62/160 |
| 4,607,408 | 8/1986 | Didier et al. | 8/159 |
| 4,835,991 | 6/1989 | Knopp et al. | 68/12 |
| 5,042,276 | 8/1991 | Kamano et al. | 68/12.04 |
| 5,161,393 | 11/1992 | Payne et al. | 68/12.04 |
| 5,241,845 | 9/1993 | Ishibashi et al. | 68/12.02 |
| 5,284,523 | 2/1994 | Badami et al. | 134/18 |
| 5,291,626 | 3/1994 | Molnar et al. | 8/158 |
| 5,313,964 | 5/1994 | Dausch et al. | 134/57 |
| 5,330,580 | 7/1994 | Whipple, III et al. | 134/18 |
| 5,390,117 | 2/1995 | Graf et al. | 701/57 |
| 5,427,313 | 6/1995 | Davis, Jr. et al. | 236/49.3 |
| 5,491,775 | 2/1996 | Madau et al. | 706/4 |
| 5,577,283 | 11/1996 | Badami et al. | 8/158 |
| 5,600,310 | 2/1997 | Whipple, III et al. | 340/825.06 |
| 5,600,961 | 2/1997 | Whipple, III | 62/175 |
| 5,669,095 | 9/1997 | Dausch et al. | 8/158 |
| 5,669,250 | 9/1997 | Dausch et al. | 68/12.02 |

OTHER PUBLICATIONS

"Intelligent Dishwasher Outsmarts Dirt", Andrea Baker, Associate Editor, Design News, Apr. 10, 1995, pp. 67–73.

"Decision–Making in a Fuzzy Environment", R. E. Bellman and L. A. Zadeh, Management Science, vol. 17, No. 4, Dec. 1970, pp. B–141–B–165.

"It Washes! It Rinses! It Talks!", Lawrence A. Berardinis, Senior Editor, Machine Design, Sep. 12, 1991, pp. 43–47.

"Sensor–of–the–Art in Household Appliances Using Fuzzy Logic", Alanna Quali and Adnan Shaout, University of Michigan, Dept. of Electrical and computer Engineering – pp. 204–213.

"Sensor Appliance control, and Fuzzy Logic", Michael Lawrence Smith, IEEE Transactions on Industry Applications, vol. 30, No. 2, Mar./Apr. 1994, pp. 305–310.

Introduction to Japanese Consumer Products that Apply Neural Networks and Fuzzy Logic, Hideyuki Takagi, University of California at Berkeley, Computer Science Division, pp. 1–8.

"Fuzzy Logic–Based Supervisory Control of Household Appliances", Vivek V. Badami, IEEE, Apr. 1997, pp. 213–217.

*Primary Examiner*—John Barlow
*Assistant Examiner*—Craig Steven Miller
*Attorney, Agent, or Firm*—Donald S. Ingraham; Douglas E. Stoner

[57] ABSTRACT

A household appliance includes a supervisory level controller for controlling operation of the appliance in accordance with operator-determined performance objectives. The supervisory level controller includes a disturbance parameter estimator coupled to receive appliance condition signals from sensor systems on the appliance for processing the signals to generate estimated appliance operating states; a sequential sensor integrator for generating a temporally-integrated estimated appliance operating state signal; and an optimizer coupled to the sensor systems and the sequential sensor integrator to receive signals therefrom and process those signals in accordance with a fuzzy logic architecture to generate control signals for application to actuator systems of the appliance in correspondence with operator-determined performance objectives.

24 Claims, 5 Drawing Sheets

APPLIANCE PERFORMANCE CONTROL APPARATUS AND METHOD

CROSS-REFERENCE TO RELATED APPLICATIONS

This application claims the benefit of U.S. Provisional Application Ser. No. 06/030,663, filed Nov. 12 1996.

BACKGROUND OF THE INVENTION

FIELD OF THE INVENTION

The field of this invention relates to household appliances and, more particularly, to controlling the performance of household appliances.

BACKGROUND

Appliance control technology has developed to incorporate improved sensors and controls. Most appliances in the 1970's used open-loop, non-sensor based electromechanical controls. These were primarily motor-controlled timers such as the rotary wash cycle selector found on many washing machines. Appliance control in the early 1980s, however, changed fundamentally with the introduction of electronic controls and sensors. A high-end washer, for example, would have up to two microcontrollers; one for controlling the user interface and the cycling of the appliance during a wash cycle, and another microcontroller for controlling the motor and drive electronics. These early 1980's appliances remained primarily open-loop in that sensor feedback was not used to optimize the performance of the appliance. In the late 1980's appliances were introduced with fuzzy logic-based and conventional control to control the appliance cycle.

There are several examples of appliance control using fuzzy logic. In Fuzzy Logic Controlled Washing Machine, Proceedings of IFSA, 97 (Brussels 1991), Kondo et al. describe a clothes washer controlled by fuzzy logic. An optical turbidity sensor provides a measure of water soil during a wash. The rate of change of the turbidity signal is used to infer the type of soil and the necessary washing time. U.S. Pat. No. 5,241,845 to Ishibashi et al. describes a washing machine using a neural network to determine the agitation pattern and washing time based upon inputs of clothes volume, clothes type, soil level, soil type, detergent volume, detergent type, and water temperature.

There are further examples. Merloni Elettrodomestica produces a washer that estimates the quantity of the clothes load and the fabric type. The load and fabric is inferred from the rate of change of a water level sensor signal. Cotton fabric will, for example, absorb water at a much faster rate than synthetic fabrics. Washing time and water temperature is inferred from a water conductivity sensor. Hard water has a higher conductivity and may require longer wash times and warmer water. In Industrial Applications of Fuzzy Technology, Springer-Verlag (1993), K. Hirota describes a vacuum cleaner that senses the floor surface and the amount of dust to adjust the vacuum suction power. An optical sensor measures the dust passing through the suction hose. The type of floor is inferred from the rate of change of dust when cleaning has started; a bare wooden floor, for example, releases dirt quickly, while a deep pile carpet releases dirt slowly.

The above appliance control strategies have focused on controlling low-level parameters such water temperature and water level in a clothes washer, or clothes dryness in a dryer, or fresh food and freezer temperatures in a refrigerator. These parameters, in general, are not of primary concern to the user of the appliance. Most often the user is more interested in specifying higher level performance-based parameters.

There is, accordingly, a need in the art to control a household appliance on a performance-based level, providing the operator the ability to control the appliance on the basis of supervisory level goals such as energy consumption, or level of accomplishment of various tasks performed by the appliance, such as level of cleanliness or the like, and remain within the cost limitations of the market.

SUMMARY OF THE INVENTION

In accordance with the present invention, a household appliance comprises a performance-based supervisory controller. The supervisory controller is coupled to sensor systems and actuator systems that in turn are coupled to the mechanical and electrical subsystems of the appliance. The supervisory controller comprises a disturbance parameter estimator, a sequential sensor integrator, and an optimizer that are coupled together to provide estimation of non-directly measurable disturbance parameters; integration of various sensed and estimated sensor parameters; and device performance level control.

The optimizer typically comprises at least an open loop level of subcomponents for generating actuator commands to control the appliance at the performance level. These open loop level subcomponents include a constraint generation module, an objective (or goal) generation module, and an optimization module. In one embodiment the optimizer further comprises a closed loop level of subcomponents, which include a performance estimator module and an objectives modification module, which are coupled together and to the open loop subcomponents to provide closed loop control at the supervisory level of control for the appliance. The optimizer incorporates a fuzzy logic architecture that is responsive to user-established performance-level goals, operating constraints, and sensed and estimated appliance parameters that are processed so as to generate control signals to be applied to the actuator systems.

A method of controlling a household appliance includes estimating appliance disturbance parameters using a fuzzy logic compositional rule of inference to control performance of the appliance, including the steps of: applying signals from device sensor systems to an estimator to generate estimated appliance operating state signals; applying the estimated appliance operating states signals to a sequential sensor integrator to generate a temporally-integrated estimated appliance operating state signals; applying the temporally-integrated estimated appliance operating state signals and signals from the device sensor systems to an optimizer for processing in accordance with a fuzzy logic architecture performance level control decisions such that control signals are generated to be applied to appliance actuator systems to operate the device to achieve desired user-supplied performance level goals

BRIEF DESCRIPTION OF THE DRAWINGS

These and other features, aspects, and advantages of the present invention will become better understood when the following detailed description is read with reference to the accompanying drawings wherein.

DETAILED DESCRIPTION

Figure 1:
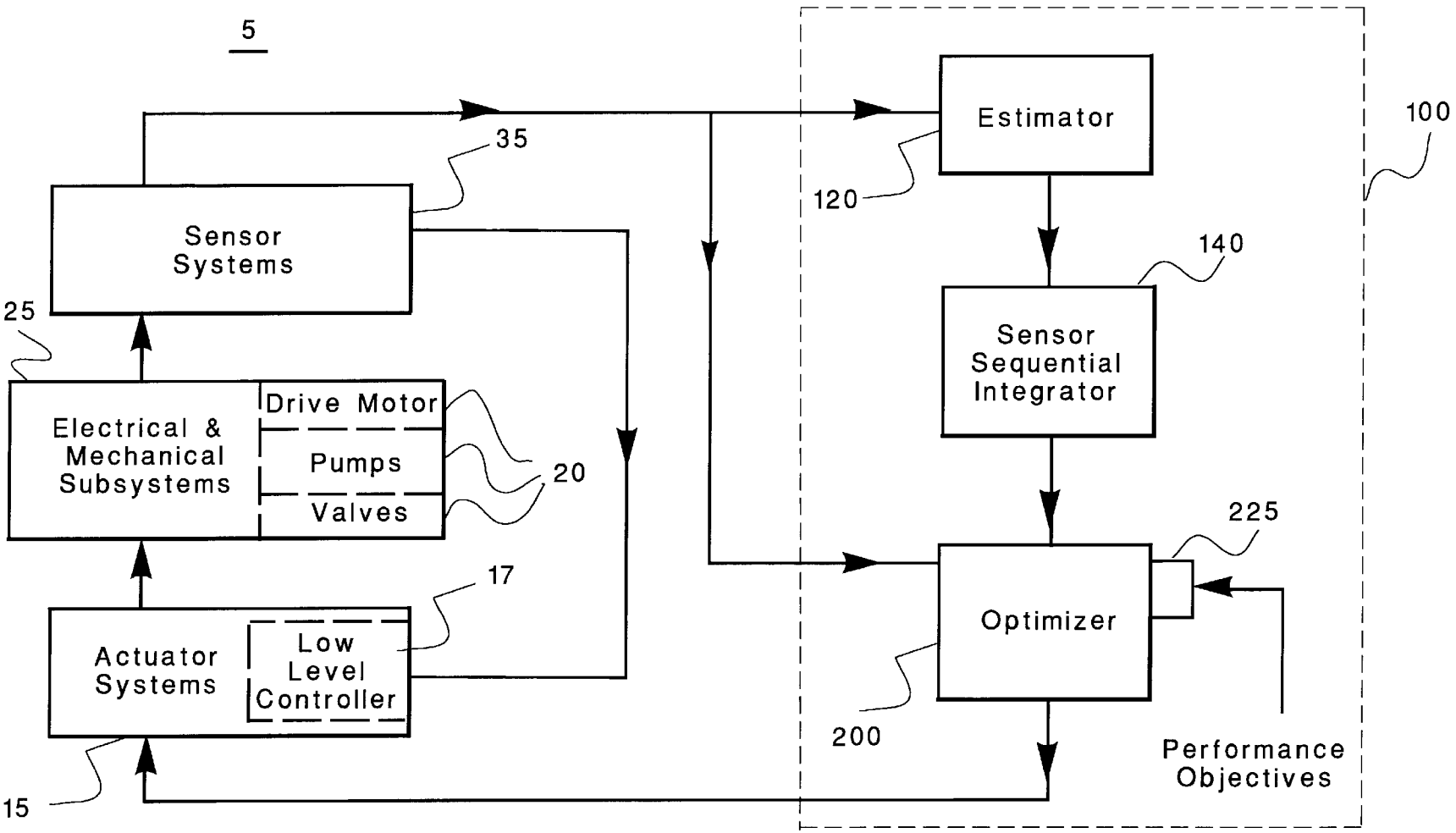
FIG. 1 is a block diagram of an appliance having a supervisory control system of the present invention.

FIG. 1 shows a block diagram of a supervisory controller 100 for use in a household appliance 5. Appliance 5 may comprise clothes washers, clothes dryers, dish washers, food cooling equipment, and refrigeration equipment. By way of example and not limitation, appliance 5 as described herein comprises a clothes washing machine; the controller architecture and structure described herein can also be adapted (with appropriate algorithms and sensors) for control of operation of the other types of household appliances described above.

Appliance 5 comprises electrical and mechanical subsystems 25 including a plurality of components 20 such as drive motors, pumps, valves, and the like (only representative ones of which are illustrated). Typically operation of each component 20 is determined through an actuator system 15. As used herein, "actuator system" is used in its broader sense to include "low level" control devices 17 such as electromechanical controllers and the like for responding to a set point or command to achieve and maintain a given condition (such as water temperature or the like). Such actuator systems further include the devices that energize and deenergize components or otherwise (e.g., with pneumatic or hydraulic systems) control the position or operation of a component, such as a valve operator, or a relay for an electrical motor.

Appliance 5 further comprises a plurality of sensor systems 35 coupled to electrical and mechanical subsystems 25 to detect information on operation of the device. As used herein, "sensor systems" is used in its broadest sense to include both the detector of a given condition in the appliance and equipment for basic processing of that information to develop appliance condition signals. For example, in a washing machine 5, such sensor systems typically comprise a basket speed sensor, water level sensors, water temperature sensors, motor torque sensors (which may be determined for a single phase induction motor by measuring electrical phase angle between motor voltage and current in real time and processing that information to determine torque); and other sensors, such as turbidity sensors and the like.

Supervisory controller 100 is coupled to sensor systems 35 and to actuator systems 15 so as to receive signals corresponding to appliance conditions and operation and apply control signals to actuator systems 15 to direct appliance operation. Supervisory controller 100 controls appliance 5 in response to supervisory level inputs to the controller from the operator.

As used herein, the terms "supervisory level" goals (also referred to as objectives, parameters, or inputs), "performance level" goals, and the like, are used to refer to commands that address ultimate desired device performance, such as (using the clothes washing machine as an example) cleaning performance, wear on the clothes, noise level, and energy usage. Almost all these performance level inputs reflect the desired overall device operation and as such are not directly measurable, or are measurable only with extraordinary difficulty and expense, neither of which are desirable from a resource standpoint for products produced in large numbers for household use. These supervisory level parameters are further typically characterized with a weighting between minimizing and maximizing (e.g., assigning a weighting value between 0 and 1) for any one or combination of the performance.

Such performance level parameters must be inferred from other signals, which are typically referred to as disturbance parameters. "Disturbance parameters" and the like are lower level system attributes that are generally easier to measure and control than disturbance parameters. Such parameters can be directly measured or determined with basic processing techniques. Examples of such parameters include wash water turbidity (soil level), water temperature, water volume, and mechanical energy imparted to the clothes. Such disturbance parameters are commonly referred to as system states (or conditions) in control system terminology, referring to measurable or observable parameters that are readily used in control systems. Load and blend estimates are referred to as "disturbances" since they are uncontrollable variables dependent on user actions. The estimator 120 produces estimates of these disturbances. Both supervisory level and process level parameters are typically represented by electrical signals or the like.

Appliances controlled with the supervisory level controller in accordance with this invention thus provide control of performance goals rather than just control of disturbance parameters. The user of a clothes washer is, for example, primarily concerned with getting a good wash in minimum time and using minimum energy; the user is not usually concerned with the level of water in the washer, the water temperature, or the amount of detergent used during the wash. By contrast, typically even the most advanced washing machines currently do not enable supervisory inputs, even though the controllers may monitor sensor systems to develop information on the size (e.g., weight) of the clothes loaded in the basket so as to adjust the water level; or monitor a variety of sensor systems (such as turbidity sensor systems) to control the duration of a wash cycle.

Appliances in which the supervisory controller of the present invention is employed typically have the following characteristics:

- the system can, in general, be described only using heuristics (e.g. linguistic rules), since qualitative (differential or difference equation) models for real time control are not available;
- the cost of developing precise quantitative control models is not warranted;
- appliances are, in general, hybrid systems (a combination of continuous and discrete time systems) and there are complex non-linear interactions between various parts of the system;
- sensor system information is sparse, noisy, incomplete, and, in many cases, not related to the process variable of interest;
- processing power is extremely limited since only the least expensive processors are used; and
- sensor system and actuator system costs must be minimized since cost constraints are paramount.

These characteristics are offset by the wealth of qualitative, empirical information available for the appliance device, and there exist qualitative rules of thumb for the process. The supervisory controller of this invention is adapted (that is, comprises computing facilities, such as a programmable computer or an application specific integrated circuit or the like) to use fuzzy logic to make explicit the use of experiment and observation and to use the mathematical rules of thumb to represent and use this information.

Fuzzy logic is a decision-making process used when the choices between alternatives or set membership is not sharply defined. Despite the fact that there is no sharp transition from membership to nonmembership in fuzzy sets, such sets do convey information despite their imprecision. Fuzzy logic refers to processes or method of making a decision when the goals and the constraints are fuzzy, imprecise, or not sharply defined.

In a fuzzy logic system the goals and constraints can be represented as separate fuzzy sets. Each member in the fuzzy set is described by a mathematical membership function. The membership function is presented by the symbol G and is a number from 0 to 1 which describes the grade of membership of each member within the fuzzy set. The fuzzy set of goals is mapped against the fuzzy set of constraints. A fuzzy decision is the choice or set of choices representing the intersection of the fuzzy goals and fuzzy constraints. Bellman and Zadeh explain the concept of fuzzy decision-making in their paper Decision-Making in a Fuzzy Environment, 17 Management Science, B-141 (1970), which is incorporated in its entirety herein by reference thereto.

Fuzzy logic, therefore, provides a convenient and powerful approach for using qualitative knowledge for making decisions. An appliance system works with a qualitative understanding of the appliance process. While many models exist for portions of the appliance process, such as detergent action, soil removal, and clothes drying, analytical models suited for total control purposes are not available. There is, however, much qualitative process data available from the designers and users of appliances.

The designers of appliances know, for example, how the motions of a washing machine's agitator affect fabric wear, soil removal, and energy consumption. Large agitator motions remove more soil, yet, fabrics wear faster. Large agitator motions also require greater energy. The motion of the agitator can be controlled by arc length and stroke. These parameters—arc length and stroke rate—are the controllable variables. The dependent variables, such as fabric wear, soil removal, and energy consumption, are difficult, if not impossible, to measure inexpensively. Fabric wear, soil removal, and energy consumption are disturbance parameters. The causal relationships between the controllable variables and the performance variables are naturally captured in a fuzzy logic framework.

In accordance with this invention, supervisory controller 100 comprises a disturbance parameter estimator 120, a sequential sensor integrator 140, and a process optimizer 16. Disturbance parameter estimator 120 is coupled to sensor systems 35 that are disposed to monitor measurable parameters of electrical and mechanical subsystems 25 of appliance 5. Disturbance parameter estimator 120 is adapted to process the sensed (or measurable) parameters from sensor systems 35 in accordance with fuzzy logic decision architecture. As used herein, "adapted to", "configured" and the like refer to computational devices (such as programmable computing devices and application specific integrated circuits, or the like), that are programmed with algorithms to provide a desired computation processing of signals applied to the device. Disturbance parameter estimator generates estimate signals for parameters such as clothes load or blend of clothes (e.g., cotton-type fabrics or delicate-type fabrics). Disturbance parameter estimator 120 is coupled to sequential sensor integrator140 which provides an integration and weighting function over time of the various estimate signals generated by disturbance parameter estimator 120. Optimizer 200 is coupled to both sensor systems 35 to receive appliance status signals therefrom and to sequential sensor integrator 140 to receive the integrated estimate signals from disturbance parameter estimator 120. Optimizer 200 further comprises modules adapted to generate optimal device performance objectives in correspondence with user performance goals, device constraints, as modified by performance modeling estimates. Optimizer 200 is further coupled to actuator systems 15 so that device performance objective signals are applied thereto for control of electrical and mechanical subsystems of appliance 5.

Disturbance parameter estimator 120 processes signals received from sensor systems 35 in accordance with a fuzzy logic protocol in order to generate signals corresponding to disturbance parameter estimates. By way of example and not limitation, estimator 120 in a washing machine 5 is typically adapted to generate signals corresponding to clothes load (weight or amount of clothes in the wash basket) and clothes blend (the type of clothes loaded, e.g., cottons or delicates) by processing of sensor system signals corresponding to appliance conditions such as water level, motor torque, agitator stroke, and the like.

The basic formula for a fuzzy-logic based parameter estimate is the compositional rule of inference, which is presented as:

signal processing+a priori knowledge=disturbance parameter estimate.

Disturbance parameters can be derived from an understanding of the physics of the process. For example, a rule base is developed to represent the causal relationship between the actuator system values (such as water temperature, water level, agitator stroke rate, etc.) and performance measures (such as fabric wear, soil removal, and energy consumption) in a rule based format. Such empirical data are available from experienced appliance designers and testers. The fuzzy logic rule base is refined through calibration with test results.

The second major component of supervisory controller 100 control architecture is a sequential sensor integrator 140. Sequential provides progressively improved parameter estimates as the process progresses in time. Thus, as the wash cycle progresses, the disturbance parameter estimates generated by estimator 120 are progressively integrated (or fused—as used herein, "integrated" is used to refer to weighted averaging of sequential estimates as opposed to a purely mathematical function) so as to refine the estimate of the disturbance parameter. For example, in a washing machine for clothes, disturbance parameter estimates are updated by estimator 120 throughout the wash cycle and these estimates are fused to form a combined estimate by sequential integrator 140. Thus, supervisory controller 100 in a washing machine generates disturbance parameter estimates from the FILL cycle, which estimates are used for appliance control and further refined in the WASH cycle; disturbance parameter estimates from the WASH cycle are used and refined in the DRAIN cycle, and so forth.

Optimizer 200 is coupled to sequential sensor integrator 160 so as to receive the integrated estimate signals and is further coupled to at least some of the individual sensor systems 35 so as to receive appliance status signals directly from the sensor systems 35 (or lower level controllers (not separately illustrated)) that may perform more elemental processing of the data, such as determination of motor torque from comparison of voltage supply line phase and motor electrical phase information). Optimizer 200 is adapted to incorporate the refined disturbance parameters generated by integrator 140 and appliance status parameters from sensor systems 35 into a high-level control loop that optimizes the appliance process with respect to a given set of performance criteria. Examples of performance criteria for washing clothes include:

minimizing water and energy consumption, minimizing clothes wear, minimizing detergent usage, minimizing noise, minimizing cycle time, and maximizing cleaning or damp drying performance.

Figure 2:
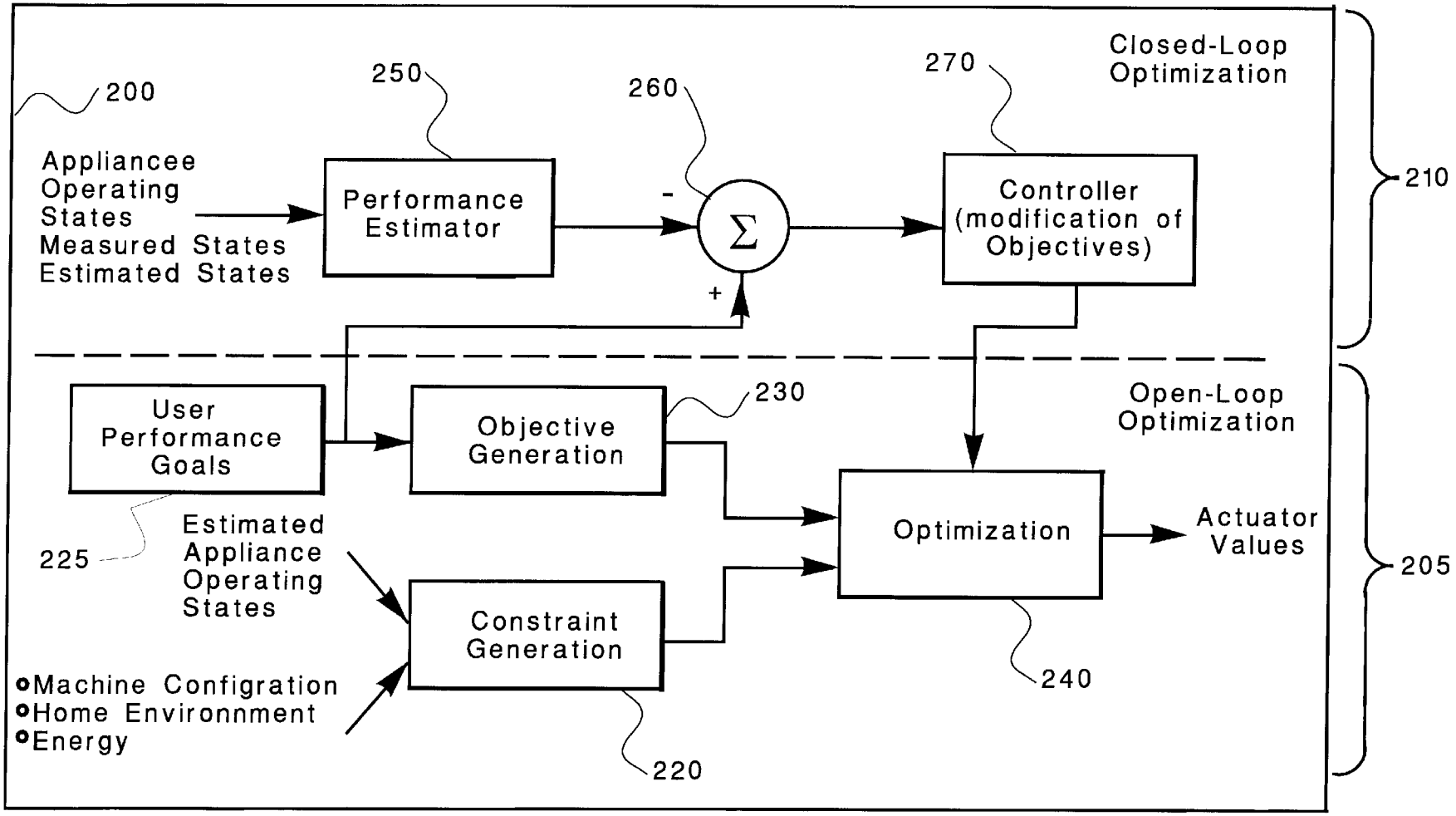
FIG. 2 is a block diagram of an optimizer in a supervisory control system of the present invention.

Optimizer 200 comprises a number of subcomponents to generate control signals to cause appliance operation in correspondence with the supervisory level commands applied to the controller 100 by the user of the appliance. In one embodiment of optimizer 200 as illustrated in FIG. 2, optimizer components can be categorized in an open loop level 205; in an alternative embodiment, optimizer 200 comprises both the components of open loop level 205 and a closed loop level 210. Open loop level 205 components include a constraint generation module 220; an objective generation module 230; and an optimization computation module 240. Closed loop level 210 of optimizer 200 includes a performance estimator module 250; a summing junction 260; and an objectives modification controller 270. These subcomponents are coupled together as described below to provide open loop and closed loop functionality for optimizer 200.

At open loop level 205 there are two inputs to the optimization process performed by optimizer 200: constraints and objectives (or goals). Signals representing constraints are generated by constraint module 220 and typically are in two categories: a first category of constraint signals corresponding to appliance operating states, typically the estimated operating states determined by estimator 120 and sequential sensor integrator 140, such as clothes load and fabric type (also referred to as the blend of clothes in the machine); and a second category including appliance installation and configuration signals.

The first category of constraint signals is generated in correspondence with the determination of load and blend (process disturbances) that is made by estimator 120. Clothes load and type impose constraints on the following disturbance parameters: water temperature; water level; detergent concentration; agitator mechanical power (e.g., stroke rate and arc length); and spin speed. The particular relationships between clothes load and type and the washer disturbance parameters are derived from knowledge of the washing process physics. For example, washability (e.g., level of cleaning) varies in the following ways (e.g., for increased washability): required water level increases monotonically as a function of clothes load; delicate fabric types require lower water temperatures and less mechanical energy input than fabric types such as cotton goods; cottons require more mechanical energy input than polyesters; polyesters require more detergent action than cottons for the same load size; delicate fabrics should be spun at lower speed than cottons, and the like. These parameters can be characterized by fuzzy data sets relating the variables to machine control constraints such as water temperature; water level; arc length; stroke rate; and wash time. The actual values of the width of the fuzzy sets is determined by the required accuracy of the controller 100 for a given appliance system.

Figure 6:
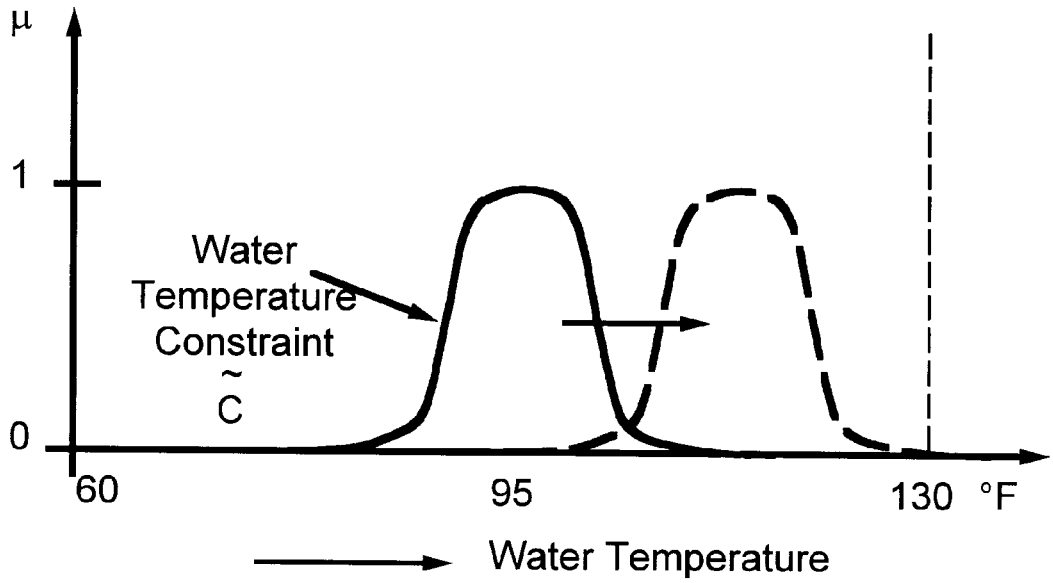
FIG. 6 is a graphical representation of exemplary constraint fuzzy sets showing a shift of constraints as a function of load and blend determinations in accordance with the present invention.

FIG. 6 illustrates one example of the shift in constraint fuzzy data sets that can occur as a result of the determination of clothes load and blend. By way of example and not limitation, for default values of clothes load (e.g., 8 lbs.) and fabric type (e.g., blends), the water temperature constraint fuzzy set is centered at 95 degrees F. For different load values determined by estimator 120, e.g., a heavier load (10 lbs.) and fabric type of cottons, the constraint fuzzy set is shifted to the right (warmer water) as illustrated in FIG. 6 in order to use a higher water temperature for the cottons as opposed to the blends default values.

A second category of process constraints derive from the physical machine configuration (e.g., reflective of machine type and capacities, such as basket capacity or pumping capacity) and available mechanical power (e.g., motor and transmission capabilities for a machine of that model type); local household constraints (e.g., hot water heater capacity); energy regulations; and product performance specification (e.g., wash time). These second category restraints affect the following appliance disturbance parameters: agitator mechanical power (stroke rate and arc length); wash time; total water consumption; detergent concentration; and water temperature. For example, the power rating of the drive motor in the washing machine determines the feasible range of agitator stroke rate and arc lengths; energy ratings of the washer impose limits on the total energy consumption of the washer, including hot water consumption and wash temperatures. The constraint signals appropriate for a given operation of the machine are generated by constraint generation module 220, typically from a look-up table of data containing data pertinent to the particular appliance installation.

Objective generation module 230 (FIG. 2) generates signals corresponding to desired goals of the user in operating the appliance device. For example, for a washing machine, such goals would include: maximizing cleaning performance; minimizing clothes wear; and minimizing energy consumption (including water use). Additional performance level goals can include minimizing detergent usage; minimizing noise; and minimizing cycle time. An appliance user may specify such performance goals either individually or in combination with one another. An input module 225 (comprising e.g., information display and switching devices for operator selection of desired objectives (e.g., a keypad or the like)) is coupled to objectives generation module to enable the operator to apply objectives selection to supervisory controller 100.

Each of the performance goals is mapped to objectives for controlled variables, constituting an inverse mapping from performance space to actuator space. Although this inverse mapping provides non-unique solutions, heuristic domain knowledge (from knowledge of the physics of operation of particular appliance machines) can be used to generate a solution, which mapping data and heuristic knowledge is stored (e.g., in electronic memory devices such as chips and the like) for use by objective generation module 230.

For example, performance goals chosen by the appliance user can be translated into maximization or minimization of controlled variables as follows:

Maximize clothes washability (1) Maximize water temperature; and (2) maximize agitator power (stroke rate and arc length); and (3) maximize wash time.

Minimize clothes wear (1) Minimize agitator power; and (2) minimize wash time.

Minimize energy use (1) minimize water temperature; and (2) minimize water level; and (3) minimize wash time.

Figure 3:
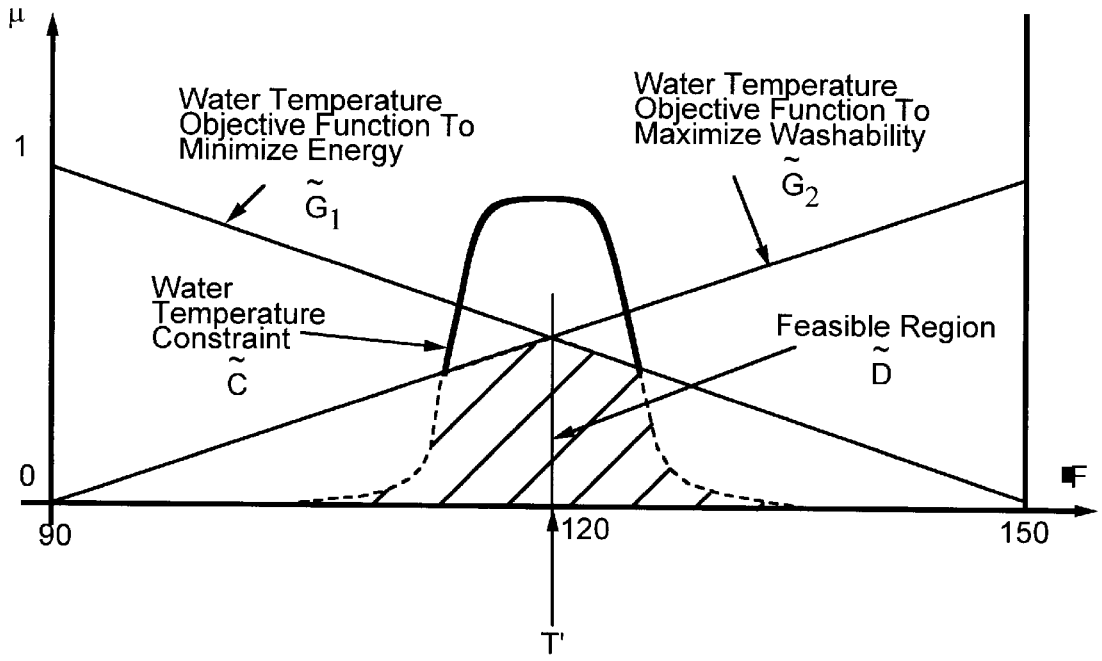
FIG. 3 is a graphical representation of exemplary fuzzy data sets showing goals and constraints for water temperature.

An illustrative representation of such a data set for water temperature determination is presented in FIG. 3. The minimization function $G_1$ results from the requirement to minimize energy use, and the maximization function $G_2$ results from the requirement to maximize washability. Both functions are represented by triangular fuzzy sets under the respective curves as illustrated in FIG. 3. The temperature constraint C is a function of the estimated clothes load and blend (in correspondence with the signal generated by estimator 120) and the look-up table relating to data. The particular shape of the fuzzy set is unimportant (e.g., the shapes may derive from any of a number of mathematical functions) so long as the intent of the maximization and minimization function is captured by the fuzzy set. As shown in the FIG. 3, the default constraint fuzzy sets are centered about the default objective fuzzy set (that is, the constraint objectives have equal weight), which in turn is dependent on the default process disturbance values.

Optimization module 240 is coupled to constraint generation modules 220 and objective generation module 230 to receive the respective constraint and goal signals therefrom and to combine those signals in accordance with the fuzzy logic approach of the present invention to generate actuator system value signals (to control operation of actuator systems 15 to operate the appliance). Optimization module 240 generated a scalar actuator system value based upon the constraint and goal fuzzy sets in accordance with a fuzzy logic analysis, for example the Bellman-Zadeh process noted above. Using the fuzzy sets illustrated in FIG. 3 as an example, the feasible region for water temperature is graphically represented by the shaded region D representing the intersection of the two goal sets $G_1$ and $G_2$ (minimize energy and maximize washability) and the constraint set C. The maximizing decision is defined as the point in the space of alternatives at which the membership function of the fuzzy set attains its maximum values. In the example shown in FIG. 3, the maximizing point is shown by T', which is selected by optimization module 240 as the set point to be applied to lower level controllers in actuator systems 15 to set the water temperature (e.g., by controlling relative volumes of hot and cold water added to the wash basket).

A similar optimization procedure can be applied to the other controlled variables, such as water level, detergent concentration, agitator stroke rate, arc length, and wash time.

In the event the appliance device operator specified different priorities for goals, objective generation module 230 is adapted to respond by shifting the weighting of pertinent goal fuzzy sets to provide the desired performance. In fuzzy set theory, relative weighting of a fuzzy data set can be represented by a shift of the associated objective functions to the left or to the right; a shift to the right corresponds to an increased emphasis in the linguistic domain. For example, if a priority of 1 (on a scale of 0 to 1) is given to washability and a priority of 0.5 is assigned to wear and energy performance, objective generation module 230 responds by shifting the relative position of the fuzzy data set for washability to the right with respect to the energy minimization data set (thus providing rightward shifts of curves for maximizing arc, stroke, and water temperature), reflecting the increased emphasis on these variables. The domain of the intersection of the curves(feasible region D) thus will also change, resulting in a shift of the maximizing function and the set point provided by optimization module to sensor systems 35.

In one embodiment of the supervisory controller 100 optimizer 200 further comprises closed loop components 210. Closed loop operation in optimizer 200 requires a process model to generate signals regarding predicted performance of the appliance device, which signals are compared with the given user performance goals. A performance estimator 250 is adapted to provide such modeling based upon first principles physics of the device and heuristic knowledge of device operation. Typically performance estimator 250 comprises a relatively simple computational device programmed to capture phenomena of interest, namely wash, wear, and energy performance. Performance estimator 250 is coupled to receive measured states signals from sensor systems 35, such as water temperature, water level, arc length, stroke time, and wash time. Additionally, performance estimator 250 is coupled to estimator 120 to receive signals corresponding to estimated states of clothes load and clothes blend in the wash basket. The modeling program of performance estimator 250 generates performance estimate signals corresponding to washability, wear, and energy use at the current time in the wash process (e.g., washability and wear signals are provided in a non-dimensional in a range selected in the design process, and energy use is expressed in kilowatt hours). Mapping of qualitative user-defined goals such as "maximize washability," "minimize wear," and "minimize energy" is done with fuzzy sets through experimentation to define the boundaries of such sets.

Figure 4:
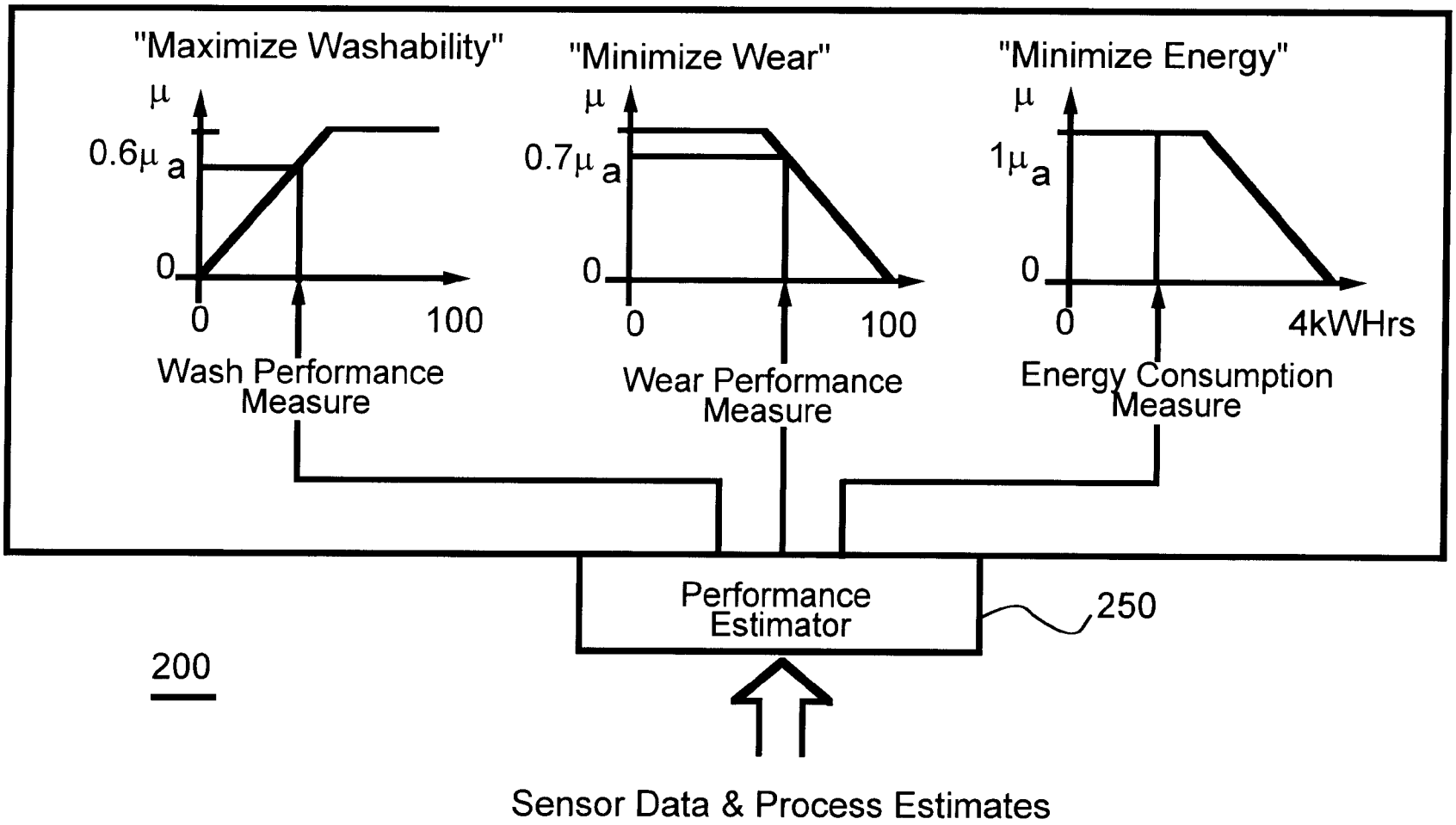
FIG. 4 is a partial block diagram and partial graphical representation of a performance estimator module of an optimizer in accordance with the present invention.

During operation, performance estimator 250 computes actual performance values (as a function of the received measured and estimated states signals) of the appliance. Performance estimator 250 generates a signal for each performance measure—washability, wear, and energy use, which, when compared with the desired user-selected goals, provides an estimate of the degree to which that performance goal is being accomplished by the appliance device at that time in the operating cycle (designated as $\mu_a$). For example, as illustrated in FIG. 4, performance estimator 250 is generating a signal indicated that actual performance (based on current operation) when compared to the fuzzy goal of "maximizing washability" indicates a 0.6 level of compliance (or accomplishment of the goal of maximizing washability) for washability; a 0.7 level of compliance for maximizing wear; and a 1.0 level of compliance for minimizing energy usage.

The differences between these degrees of fulfillment of the performance goals and 1.0 are a measure of the error in meeting the stated performance goals. So, for the case above, the errors in wash, wear and energy performance are "0.4" (1–0.6); "0.3" (1–0.7); and "0" (1—1) respectively. This error represents the degree to which that performance goal is not being met by current appliance operation. This signal is analogous to a conventional control system error between desired value (or setpoint) and the actual value. These errors are supplied to the controller (270) along with the weight value for each performance function selected by the user.

Modification controller 270 generates a modification signal to be applied to optimization module 240 (which in turn generates the control signals to actuator system 15). Modification controller is adapted to adjust the fuzzy goal sets, such as described above by shifting the relative positions of the fuzzy data sets with respect to one another. The control action is weighted by the priority attached to the particular performance goal, typically in accordance with the following relationship:

Actual shift=(Error)*(Gain)*(Priority)

in which the "error" signal is as defined above; the "gain" signal is determined from the maximum possible shift of the objective function; and "priority" is the user-specified priority for that performance goal. The maximum possible shift of an objective function in a given direction is limited by the fact that the objective and fuzzy sets must at all times intersect at at least one point in order have a non-null intersection set in order to output an actuator command.

Figure 5:
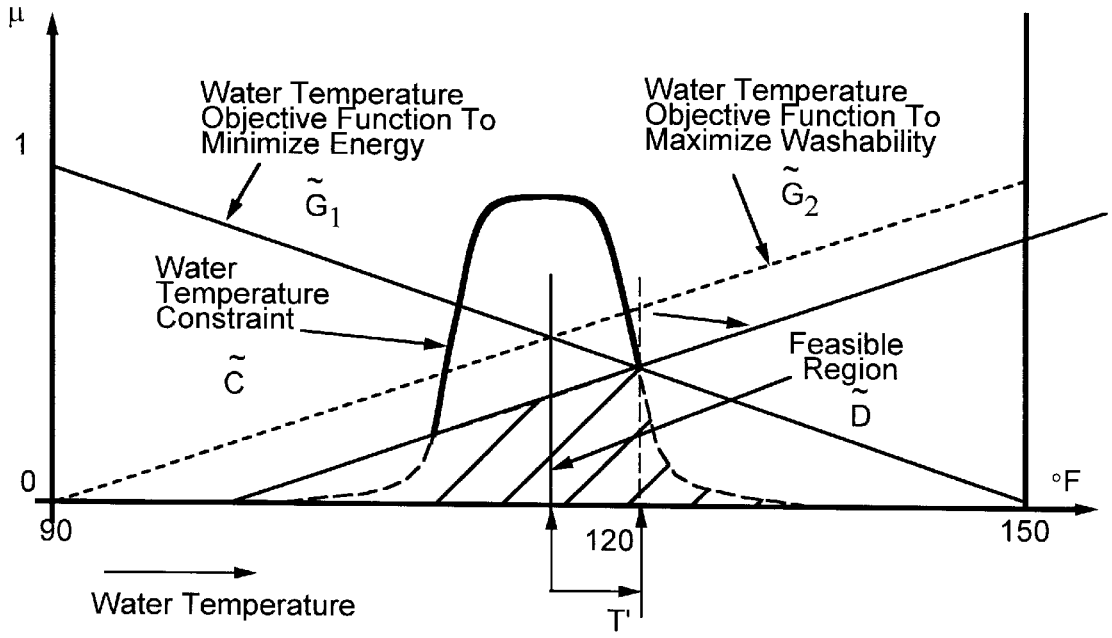
FIG. 5 is a graphical representation of exemplary fuzzy data sets showing shift of goals for water temperature resulting from closed loop operation of the supervisory control system of the present invention.

FIG. 5 provides a graphic representation of the modification process for the water temperature determination pursuant to the examples that have been used above to illustrate the present invention. In this example, the "error" signal for the degree of fulfillment of the washability goal is 0.3 (determined by the difference between 1.0 and 0.7 —see FIG. 4), resulting in a translation to the right of the water temperature objective function $G_2$ by an amount corresponding to the shift equation noted above. This shift changes the domain of the feasible region D, and the maximizing decision T' is therefore shifted to the right (as compared to the value determined as illustrated in FIG. 3). This change in T' will cause optimization module 240 to generate a change in the water temperature set point control signal provided to the actuator systems 15.

One example of the operation of the closed loop functioning of optimizer 200 is illustrated by the example given above; in a functioning washing machine the determination of washability also involves generating objectives of water temperature, arc length, stroke time, and wash time, all of which objective functions would be determined in a similar manner by the fuzzy logic architecture of optimizer 200.

Though the supervisory control system architecture 100 has been described as controlling the performance of a washing machine, it is understood the supervisory control system architecture 100 may also control the performance of other household appliances such as dryers, dishwashers, ovens, microwave ovens, refrigerators, air conditioners, and many other appliances commonly found in the residential and commercial appliance marketplace.

While the invention has been described herein with reference to specific embodiments and features, it will be appreciated the utility of the invention is not thus limited, yet, encompasses other variations, modifications, and alternative embodiments and, accordingly, the invention is, therefore, to be broadly construed as comprehending all such alternative variations, modifications, and other embodiments within its spirit and scope.

What is claimed is:

1. A household appliance performance-based control apparatus for controlling operation of an appliance in accordance with at least one operator-determined supervisory objective, comprising:

a disturbance parameter estimator for generating estimated appliance operating state signals responsive to appliance condition signals received from a sensor system in said appliance;

a sequential sensor integrator coupled to said disturbance parameter estimator, said sequential sensor integrator being configured to generate temporally-integrated estimated appliance operating state signals responsive to said estimated appliance operating state signals received from said disturbance parameter estimator; and a supervisory control system optimizer coupled to said disturbance parameter estimator and to said sensor system in said appliance so as to receive respective signals therefrom, said optimizer further being configured to generate appliance control signals responsive to said received signals and to said at least one operator-determined supervisory objective in accordance with a fuzzy logic architecture to generate control signals to be applied to said appliance for operating said appliance in accordance with said at least one operator-determined supervisory objective.

2. A control apparatus according to claim 1 wherein said optimizer comprises an open loop level of subcomponents for processing operator-determined supervisory objectives, said estimated appliance operating states, and a data set of appliance constraints.

3. A control apparatus according to claim 2 wherein said open loop level of subcomponents comprises a constraint generation module, an objectives generation module, and an optimization module coupled to said constraint generation module and said objective generation module.

4. A control apparatus according to claim 3 wherein said optimizer further comprises a closed loop level of subcomponents.

5. A control apparatus according to claim 4 wherein said closed loop level of subcomponents comprises a performance estimator and an objectives modification controller, said performance estimator being coupled to said objectives modification controller and said objectives modification controller being coupled to said optimization module in said open loop level of subcomponents.

6. A control apparatus according to claim 5 wherein said optimizer is adapted to apply a fuzzy logic rule based methodology to generate appliance control signals, wherein said operator-determined appliance performance goals are expressed as fuzzy sets, wherein said constraint generation module applies appliance constraints expressed as fuzzy sets.

7. The control apparatus according to claim 1 wherein said disturbance parameter estimator is configured to generate said estimated appliance operating state signals responsive to appliance condition signals received from a sensor system in said appliance in accordance with a fuzzy logic decision architecture.

8. The control apparatus according to claim 1 wherein said optimizer is coupled to an actuator system so as to apply generated control signals thereto to direct operation of electrical and mechanical subsystems in said appliance.

9. The control apparatus of claim 1 wherein said appliance is selected from the group consisting of clothes washers, clothes dryers, dish washers, food cooking equipment, and refrigeration equipment.

10. A method of controlling performance of a household appliance in accordance with operator-determined performance level goals, the method comprising the steps of:

applying estimated appliance operating state signals and measured appliance operating state signals to an optimizer for processing in accordance with a fuzzy logic architecture performance level control decisions such that control signals are generated to be applied to appliance actuator systems to operate the appliance to achieve said operator-determined performance level goals.

11. The method of claim 10 further comprising the step of applying signals from appliance sensor systems to an estimator to generate estimated appliance operating state signals.

12. The method of claim 11 further comprising the step of applying the estimated appliance operating states signals to a sequential sensor integrator to generate a temporally-integrated estimated appliance operating state signal and applying said temporally-integrated appliance operating state signal to said optimizer.

13. The method claim 10 further comprising the step of applying the control signals generated by said optimizer to actuator systems in said appliance to direct operation of electrical and mechanical subsystems of said appliance.

14. The method of claim 10 wherein the step of applying said estimated appliance operating state signals and measured appliance operating state signals to said optimizer for processing comprises the steps of:

generating an appliance constraints fuzzy data set in a constraint generation module;

generating a performance objectives fuzzy data set in and objectives generation module; and processing said appliance constraints fuzzy data set and said performance objectives fuzzy data set in an optimization module in accordance with a fuzzy logic decision algorithm to generate control signals for application to said appliance actuator systems.

15. The method of claim 14 wherein the step of applying said estimated appliance operating state signals and measured appliance operating state signals to said optimizer for processing further comprises the steps of:

generating a device performance estimate in accordance with a modeled performance estimator;

generating an error signal representative of the difference between the device performance estimate and the operator-determined performance goals;

applying said error signal to a objectives modification controller to generate objectives correction signal; and applying said objective correction signal to said optimization module.

16. The method of claim 10 further comprising the step of processing said estimated appliance operating state signals and measured appliance operating state signals and operator determined performance level goals in an open loop level of said optimizer.

17. The method of claim 10 further comprising the step of processing said estimated appliance operating state signals and measured appliance operating state signals and operator determined performance level goals in a closed loop level of said optimizer.

18. An appliance with electrical and mechanical subsystems therein, said appliance comprising:

at least one sensor system coupled to said electrical and mechanical subsystems to generate signals representative of appliance operating conditions and at least one actuator system coupled to said electrical and mechanical subsystems to control operation thereof; and a supervisory level control system coupled to said at least one sensor system and said at least one actuator system, said control system comprising:

an estimator coupled to said sensor system for generation of estimated appliance operating states;

a sequential sensor integrator coupled to said estimator for generating a temporally-integrated estimated appliance operating state signal; and an optimizer coupled to said sensor system and said sequential sensor integrator for generation of control signals to be applied to said actuator systems to direct operation of said electrical and mechanical subsystems in accordance with operator-determined performance objectives.

19. An appliance in accordance with claim 18 wherein said optimizer comprises open loop control subcomponents and closed loop control subcomponents so as to provide closed loop control of said operator-determined performance objectives.

20. An appliance in accordance with claim 18 wherein said optimizer comprises:

an objectives generation module for generating an appliance operating objectives fuzzy data set responsive to said operator-determined performance objectives;

a constraint generation module for generating an appliance constraints fuzzy data set responsive to environmental limitations and said temporally-integrated estimated appliance operating state signals;

an optimization module coupled to said objectives generation module and said constraint generation module for generating actuator values in accordance with a fuzzy logic decision architecture responsive to said appliance operating objectives fuzzy data set and said appliance constraint fuzzy data sets;

a performance estimator coupled to said at least one sensor system and to said sequential sensor integrator for generating an appliance performance estimate correlating appliance actual performance with modeled desired performance corresponding to said operator-determined performance objectives;

a summing junction coupled to said performance estimator for comparing said appliance performance estimate with said operator-determined performance objectives to generate and error signal corresponding to the degree of fulfillment of said operator-determined performance objectives; and an objectives modification controller coupled to said summing junction and to said optimization module for generating an objectives correction signal and applying said objectives modification signal to said optimization module to provide closed loop control corresponding to said operator-determined performance objectives.

21. An appliance in accordance with claim 20 wherein said appliance comprises a washing machine for cleansing clothes, and said user-determined performance objectives are selected from the group consisting of minimizing energy consumption; minimizing clothes wear; maximizing cleaning performance; minimizing detergent usage; minimizing noise, minimizing cycle time.

22. An appliance in accordance with claim 21 wherein said control signal for application to said at least one actuator system is selected from the group consisting of water temperature, water level, agitator arc length, agitator stroke rate, detergent concentration, and washing time.

23. An appliance in accordance with claim 20 wherein said environmental conditions applied to said constraint generation module comprise physical machine configuration, local household constraints, energy regulations, and product performance specifications.

24. An appliance in accordance with claim 20 wherein said optimizer is adapted for processing respective fuzzy data sets for generating control signals for application to respective actuator systems in said appliance, said processing of respective fuzzy data sets being in accordance with a fuzzy logic decision rule corresponding to a maximum membership intersection of said respective fuzzy data sets processed for a respective control signal.

* * * * *